US006276963B1

(12) United States Patent
Avery et al.

(10) Patent No.: US 6,276,963 B1
(45) Date of Patent: Aug. 21, 2001

(54) ADAPTER FRAME ASSEMBLY FOR ELECTRICAL CONNECTORS

(75) Inventors: Hazelton P. Avery, Batavia; Emanuel G. Banakis, Naperville, both of IL (US); Dennis Lee Doye, Maumelle; Michael J. Miskin, Little Rock, both of AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/552,241

(22) Filed: Apr. 19, 2000

(51) Int. Cl.[7] ..... H01R 13/60; H01R 13/66
(52) U.S. Cl. ..... 439/541.5
(58) Field of Search ..... 439/541.5, 607, 439/710

(56) References Cited

U.S. PATENT DOCUMENTS 4,386,814 * 6/1983 Asick ..... 439/607
5,194,018 * 3/1993 Lopata et al. ..... 439/541.5
5,546,281 * 8/1996 Poplawski et al. ..... 361/752
6,095,862 * 8/2000 Doye et al. ..... 439/607

* cited by examiner

*Primary Examiner*—Brian Sircus
*Assistant Examiner*—Brian S. Webb
(74) *Attorney, Agent, or Firm*—A. A. Tirva

(57) ABSTRACT

An adapter frame assembly is provided for receiving at least a pair of connectors in a stacked array with one connector above another connector at different spacings therebetween. The assembly includes at least a pair of frame structures including at least a top frame structure and a bottom frame structure each including a receptacle for receiving a respective one of the stacked connectors. The top frame structure may be mounted directly on top of the bottom frame structure and, thereby, space the receptacles and the respective connectors at a first spacing therebetween. A spacer is selectively mountable between the frame structures to thereby space the receptacles and the respective connectors at a second, increased spacing therebetween.

15 Claims, 9 Drawing Sheets

ADAPTER FRAME ASSEMBLY FOR ELECTRICAL CONNECTORS

FIELD OF THE INVENTION

This invention generally relates to the art of electrical connectors and, particularly, to an adapter frame assembly for mounting at least a pair of connectors in a stacked array with one connector mounted above another connector at different spacings between the connectors.

BACKGROUND OF THE INVENTION

Electrical connectors are used in a wide variety of applications ranging from simple connecting interfaces between hard conductor wiring to more sophisticated applications involving such components as printed circuit boards, flat flexible cables and optical fibers. Basically, electrical connectors include some form of contacts, terminals or other conductors which interconnect one electrical device to another electrical device. The electrical connectors may involve systems whereby the connectors provide receiver-transmitter functions which, in addition, can convert high speed signals from solid (copper) cables or fiber optic cables to high speed signals on a system printed circuit board. As used herein, the terms "electrical" or "electrical connectors" or "electrical cable" are intended to include optical devices.

For instance, in the telecommunications industry, switching systems or circuitry may be provided on a rather sizable mother board at a particular location. A plurality of high speed electrical converter modules are mounted by appropriate frame structures on the mother board. Mating "plug-in" connector modules are plugged into the converter modules from outside the switching system. The incoming signals from the cables attached to the plug-in modules are at high speed, such as in the gigabit range, and the converter modules transfer and maintain the signals at high speed and transmit them to the circuitry on the mother board. Continuing problems have been encountered in the design and manufacturability of such systems. One of the problems involves providing a system wherein the connector modules can be mounted above the mother board at different spacings between the connectors. Heretofore, completely different frame structures had to be provided to afford different stacked spacings. The present invention is directed to solving these problems by simple modifications which allow for the use of the same frame structures for differently spaced connectors.

SUMMARY OF THE INVENTION

An object, therefore, of the invention is to provide a new and improved adapter frame assembly of the character described.

In the exemplary embodiment of the invention, the adapter frame assembly is provided for receiving at least a pair of connectors in a stacked array with one connector mounted above another connector at different spacings between the connectors. At least a pair of frame structures include at least a top frame structure and a bottom frame structure each including a receptacle for receiving a respective one of the stacked connectors. Mounting means are provided on the frame structures to mount the top frame structure directly on top of the bottom frame structure and, thereby, space the receptacles and the respective connectors at a first spacing therebetween. A spacer means is selectively mountable between the frame structures to thereby space the receptacles and the respective connectors at a second, increased spacing therebetween.

As disclosed herein, the spacer means and the frame structures have aligned abutting brace members which include at least one set of aligned apertures for receiving a common elongated fastener, such as a rivet. Therefore, if the connectors are to be mounted at the first spacing therebetween, the spacer means simply is removed and shorter rivets are used to mount the top frame structure directly on top of the bottom frame structure. In the disclosed embodiment, the bottom frame structure is mounted on a printed circuit board.

Another feature of the invention is the provision of stamped and formed sheet metal gaskets about the respective receptacles of the top and bottom frame structures. Each gasket includes a plurality of outwardly projecting fingers for engaging a panel about a pair of apertures in the panel aligned with the receptacles. The fingers of the two gaskets between the receptacles are offset relative to each other to allow the frame structures to be relatively closely spaced at least in the first spacing therebetween.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
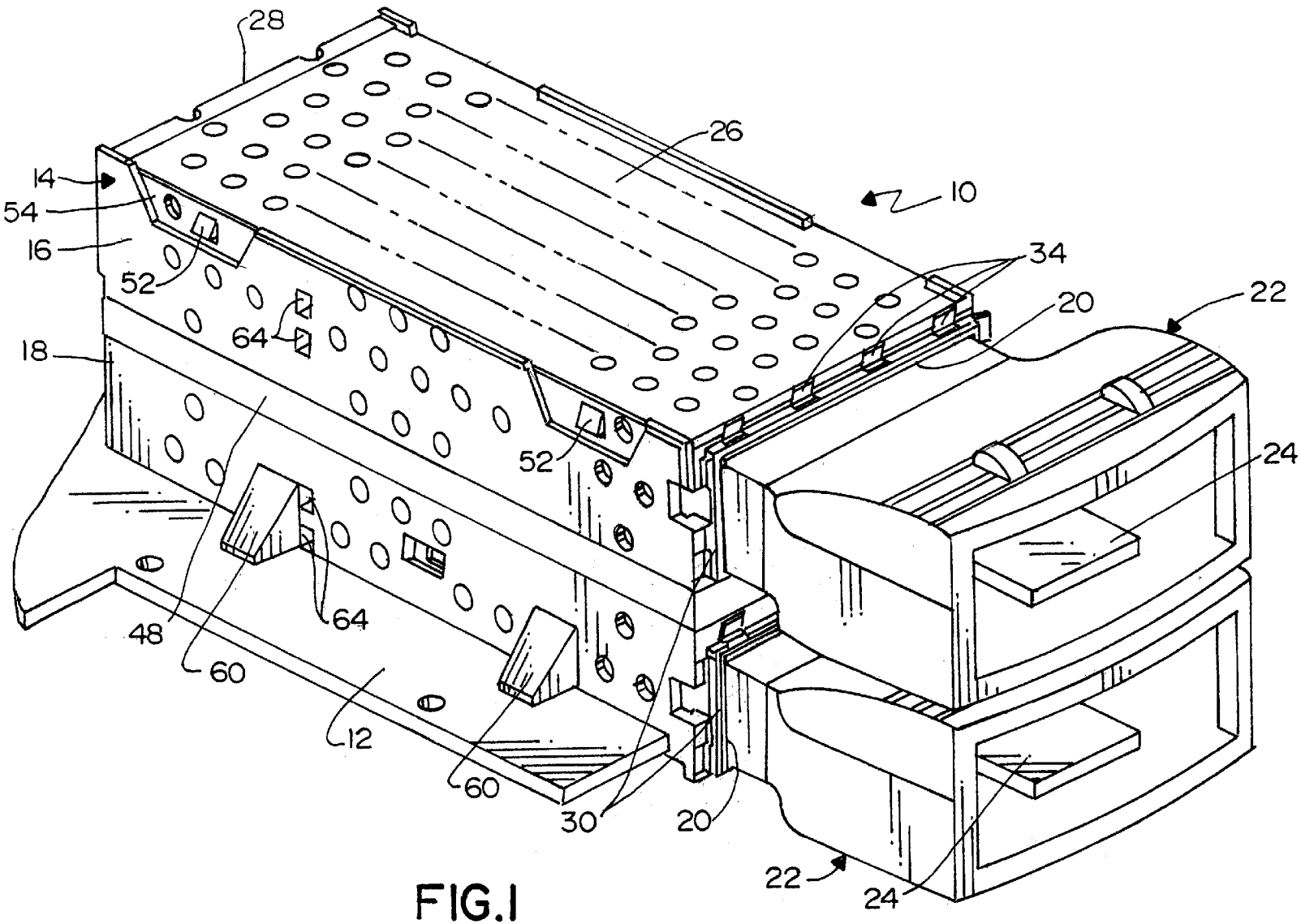
FIG. 1 is front perspective view of an electrical connector assembly incorporating the concepts of the invention.
Figure 2:
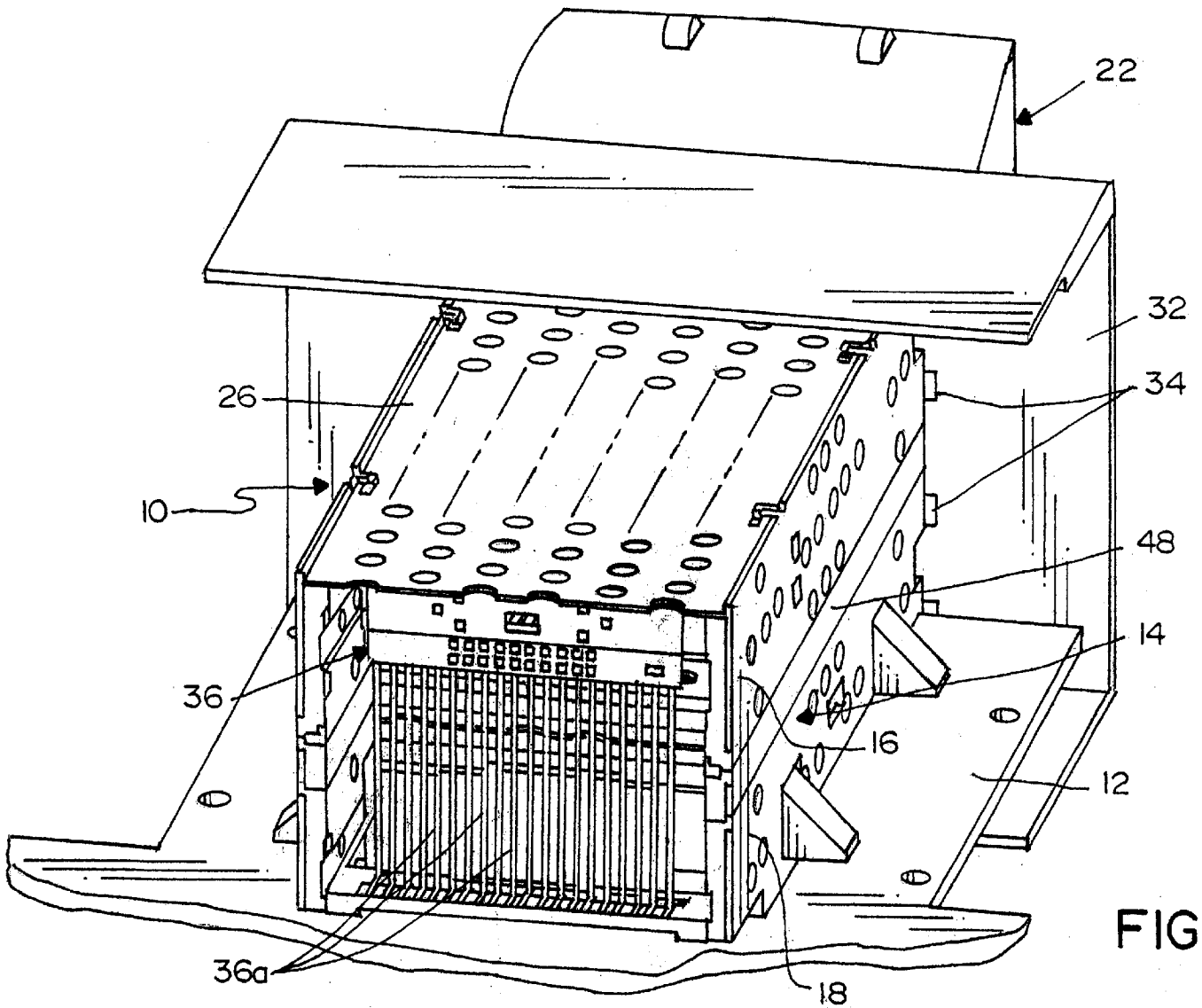
FIG. 2 is a rear perspective view of the assembly extending through a base frame, and with the rear cover of the assembly removed to show the interior thereof.

Referring to the drawings in greater detail, and first to FIGS. 1 and 2, the invention is embodied in an electrical connector assembly, generally designated 10, mounted on a printed circuit board 12 and including an adapter frame assembly, generally designated 14, which includes a top frame structure 16 and a bottom frame structure 18. Each frame structure defines a front receptacle 20 for receiving a pair of complementary mating connectors, generally designated 22, in a stacked array. In other words, mating connectors 22 are arranged with one connector mounted above the other connector at a given vertical spacing. Each of the mating connectors includes a narrow, elongated circuit board 24. Circuit board 12 can be considered the "mother" board in the overall connector assembly.

Adapter frame assembly 14 of connector assembly 10 includes a stamped and formed sheet metal top wall or cover 26 and a stamped and formed sheet metal rear wall or cover 28. The top and rear covers provide EMI protection for the assembly. A pair of EMI gaskets 30 surround front receptacles 20 which receive mating connectors 22. FIG. 2 shows the assembly mounted behind a base frame 32 which may comprise a metal or grounded chassis. EMI gaskets 30 have outwardly projecting tabs or fingers 34 for engaging the back side of base frame 32. Rear cover 28 (FIG. 1) has been removed in FIG. 2 to show various interior connector components therein. Actually, only a lead frame, generally designated 36 and including leads 36*a*, is clearly visible in FIG. 2.

Figure 3:
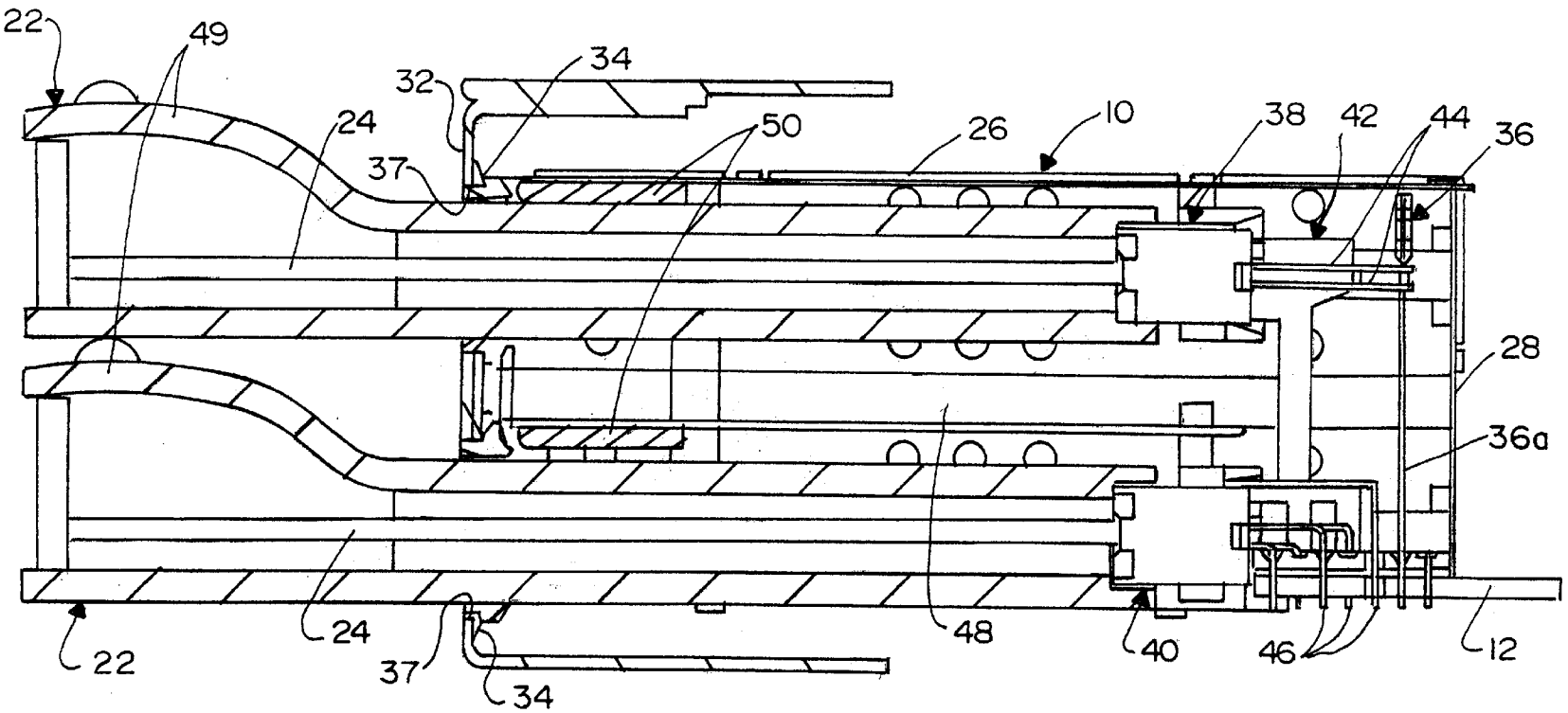
FIG. 3 is a front-to-rear section through the connector assembly.
Figure 4:
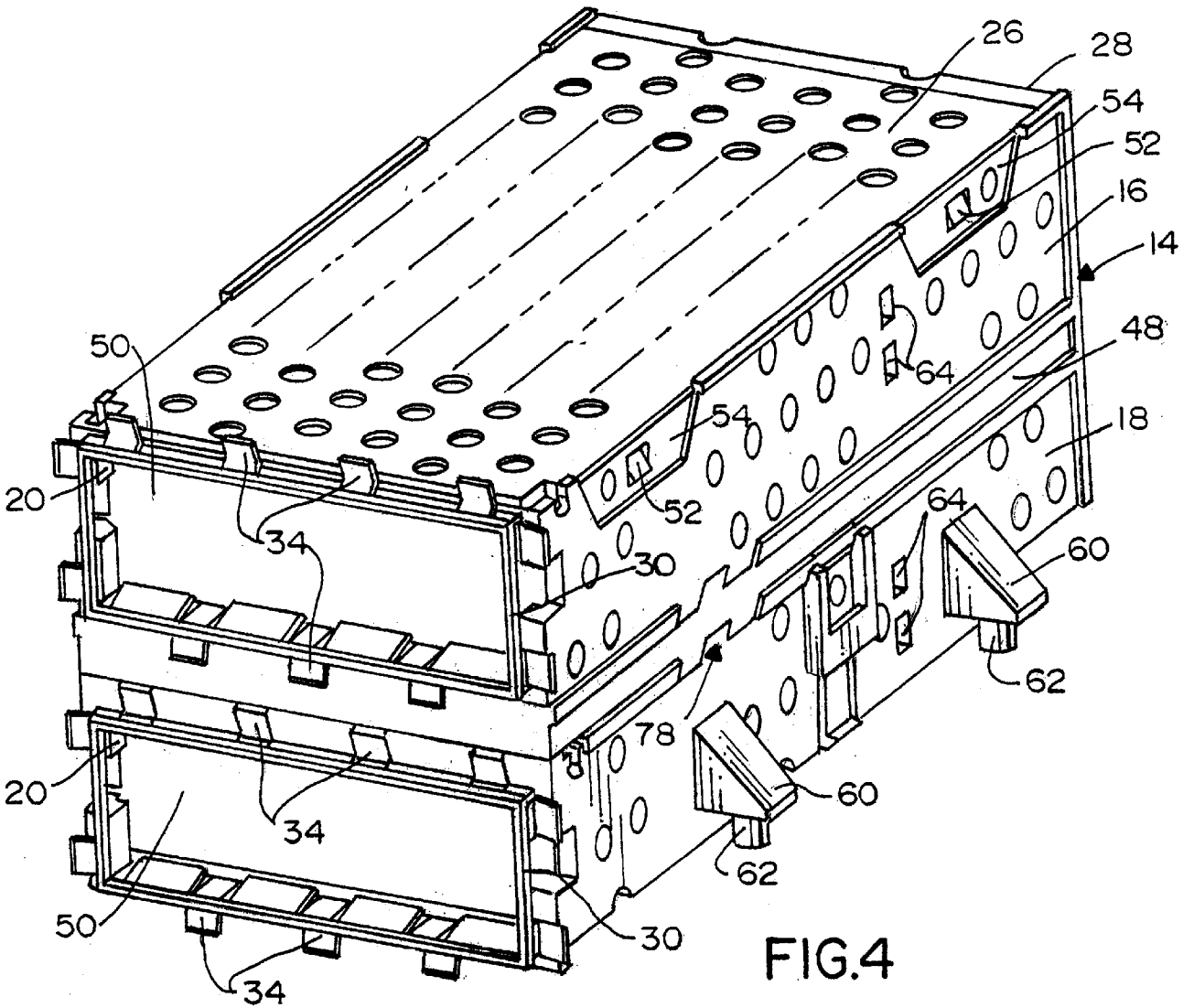
FIG. 4 is a front perspective view of the assembly, removed from the printed circuit board and with the mating connectors removed.

FIG. 3 shows a front-to-rear section through connector assembly 10 mounted to mother board 12 behind base frame 32 which includes a pair of openings 37 for receiving mating connectors 22 therethrough. It can be seen that the narrow elongated connecting circuit boards 24 of the mating connectors extend rearwardly into the connector assembly and into a pair of electrical connectors, generally designated 38 and 40. The connectors are mounted in a stacked array with one connector mounted above the other connector and held in such positions by an internal frame structure, generally designated 42. Top connector 38 includes a plurality of terminals 44 connected to mother board 12 by leads 36*a* of lead frame 36. Bottom connector 40 has a plurality of right-angled terminals 46 connected directly to mother board 12.

It can be seen in FIGS. 1–3 that frame structures 16 and 18 are spaced apart by a spacer means 48. This spacer means correspondingly spaces receptacles 20 at a given vertical spacing relative to each other for receiving mating connectors 22. As seen in FIGS. 1 and 3, and particularly FIG. 3, mating connectors 22 have enlarged or bulging portions 49 which would preclude completely inserting the connectors into connector assembly 10 without spacer means 48 separating frame structures 16 and 18.

With that understanding, reference now is made to FIGS. 4–7 to show adapter frame assembly 14 and the mounting details of top and bottom frame structures 16 and 18, respectively, along with top and rear covers 26 and 28, respectively, as well as spacer means 48. First of all, it can be seen that front receptacles 20 of the frame structures are closed by spring-loaded doors 50 when the mating connectors are removed. In FIG. 3, the mating connectors have moved doors 50 upwardly out of the path of insertion of the mating connectors. Top frame structure 16 has a plurality of chamfered latch bosses 52 over which a plurality of apertured latch flanges 54 of top cover 26 are snapped to hold the top cover down onto the top frame structure. Rear cover 28 (FIG. 7) is inserted down into a channel 56 (FIG. 5) formed at the inside of the rear edges of the top and bottom frame structures and the spacer. The rear cover has a pair of legs 58 (FIG. 7) for insertion into appropriate holes in mother board 12 for connection, as by soldering, to grounding traces on the board and/or in the holes. Bottom frame structure 18 includes a pair of wings 60 on each opposite side thereof, each wing including a downwardly projecting mounting post 62 for insertion into appropriate mounting holes in mother board 12. Finally, both the top and bottom frame structures have apertures 64 on opposite sides thereof for interengagement with latch bosses on the housings of top and bottom connectors 38 and 40 described above in relation to FIG. 3.

Figure 5:
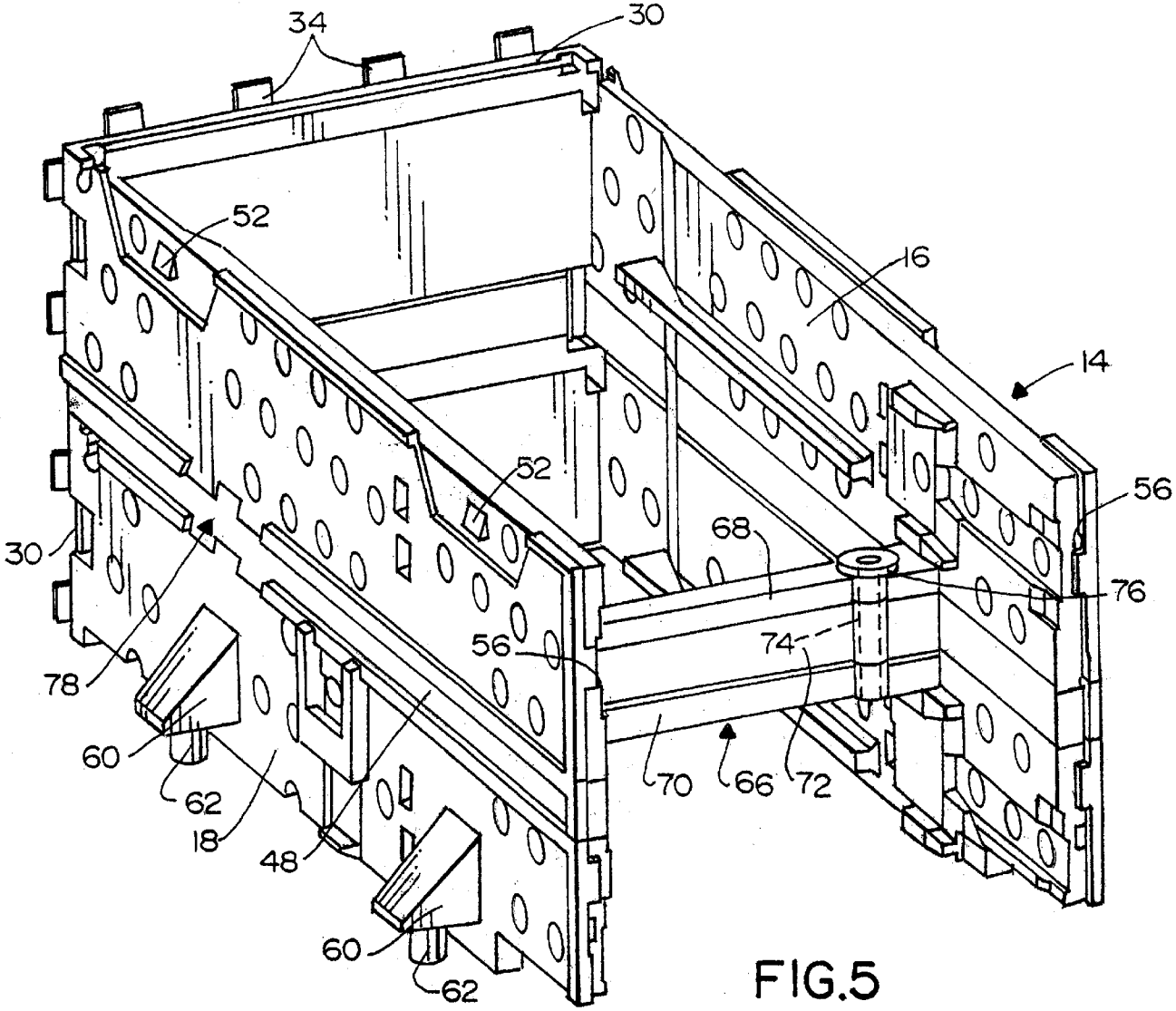
FIG. 5 is a rear top perspective view of the frame structures and spacer, with all of the interior components of the connector assembly removed to facilitate the illustration.
Figure 6:
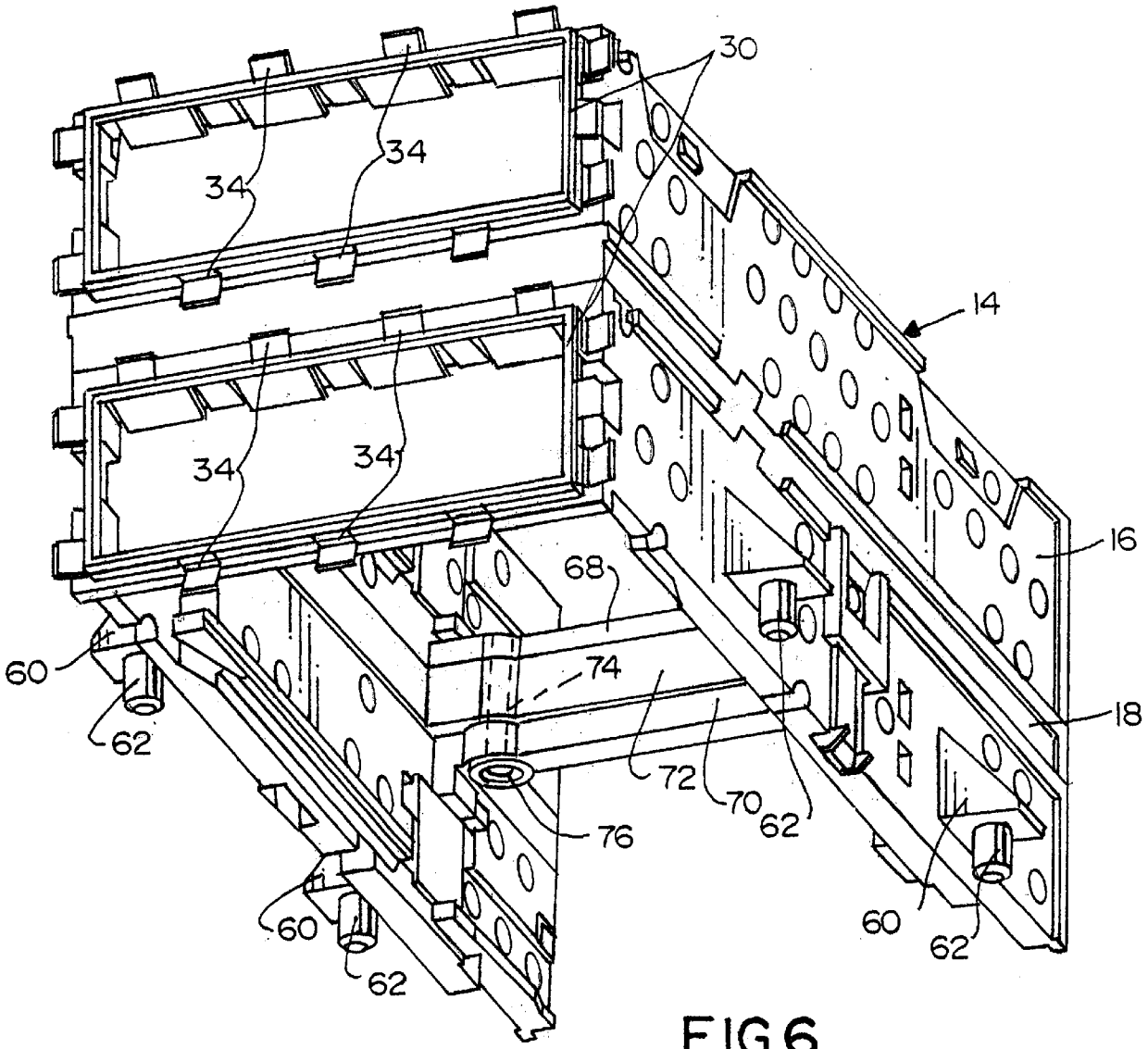
FIG. 6 is a front bottom perspective view of the frame structures and spacer as in FIG. 5.
Figure 7:
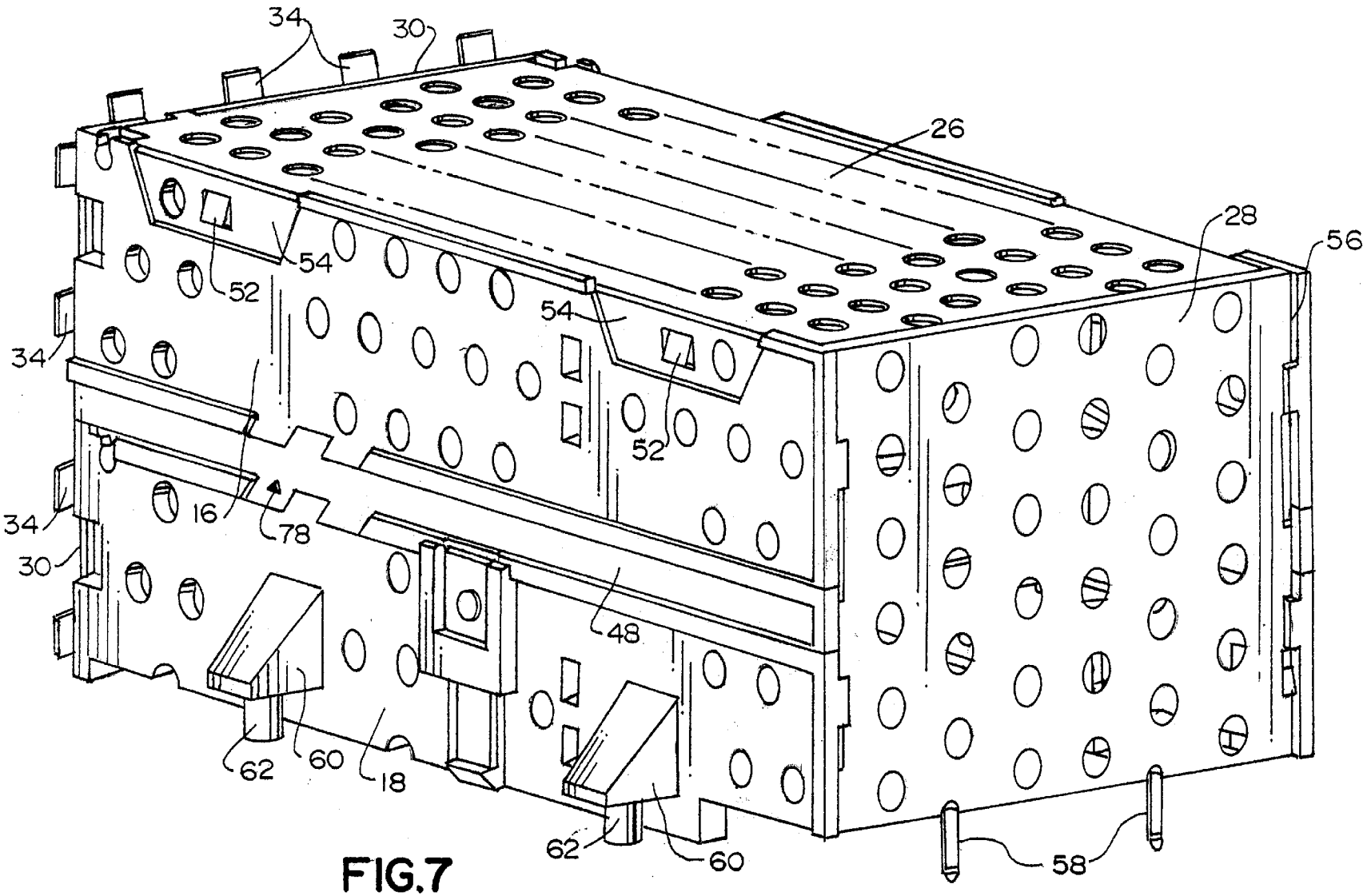
FIG. 7 is a view similar to that of FIG. 5, but with the top shielding wall and rear shielding cover attached to the frame structures.

As best seen in FIGS. 5 and 6, each of the top and bottom frame structures 16 and 18, respectively, as well as spacer 48, all are generally U-shaped and, when vertically aligned, include an aligned bracing structure, generally designated 66, near the rear thereof. In other words, top frame structure 16 includes an integral cross brace 68; bottom frame structure 18 includes an integral cross brace 70; and spacer 48 includes an integral cross brace 72. The frame structures may be fabricated of diecast metal with cross braces 68 and 70 being integrally diecast therewith. Spacer 48 may be of diecast material, molded plastic or other appropriate materials, also with cross brace 72 fabricated integrally therewith. All of cross braces 68, 70 and 72 have a set of aligned apertures 74 near each opposite end thereof for receiving a common elongated fastener, such as a rivet 76. The rivets hold the frame structures in a rigid, vertically aligned subassembly. An interengaging tongue-and-groove structure, generally designated 78, also interengages the top and bottom frame structures with spacer 48.

Figure 8:
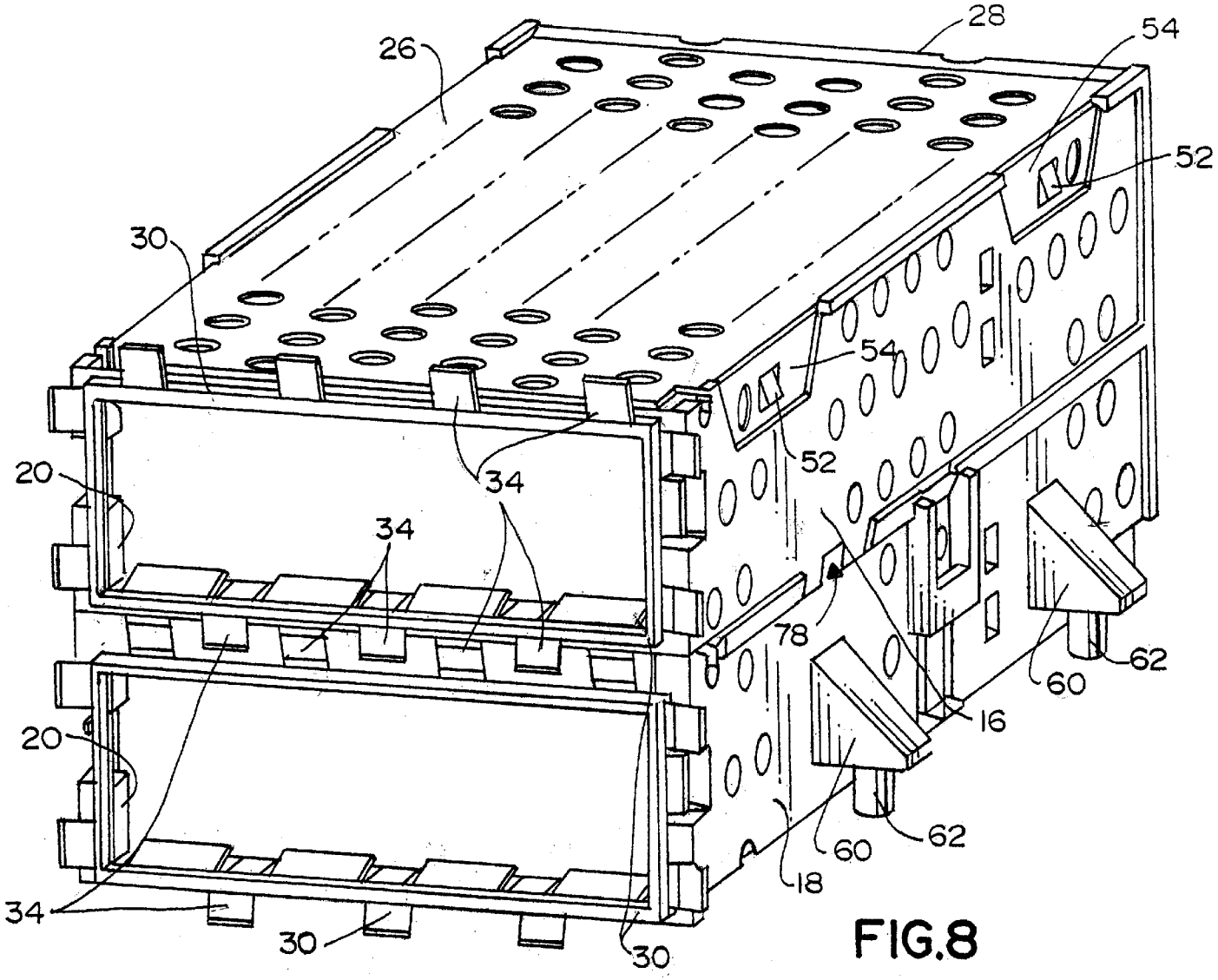
FIG. 8 is a view similar to that of FIG. 4, but with the spacer removed.
Figure 9:
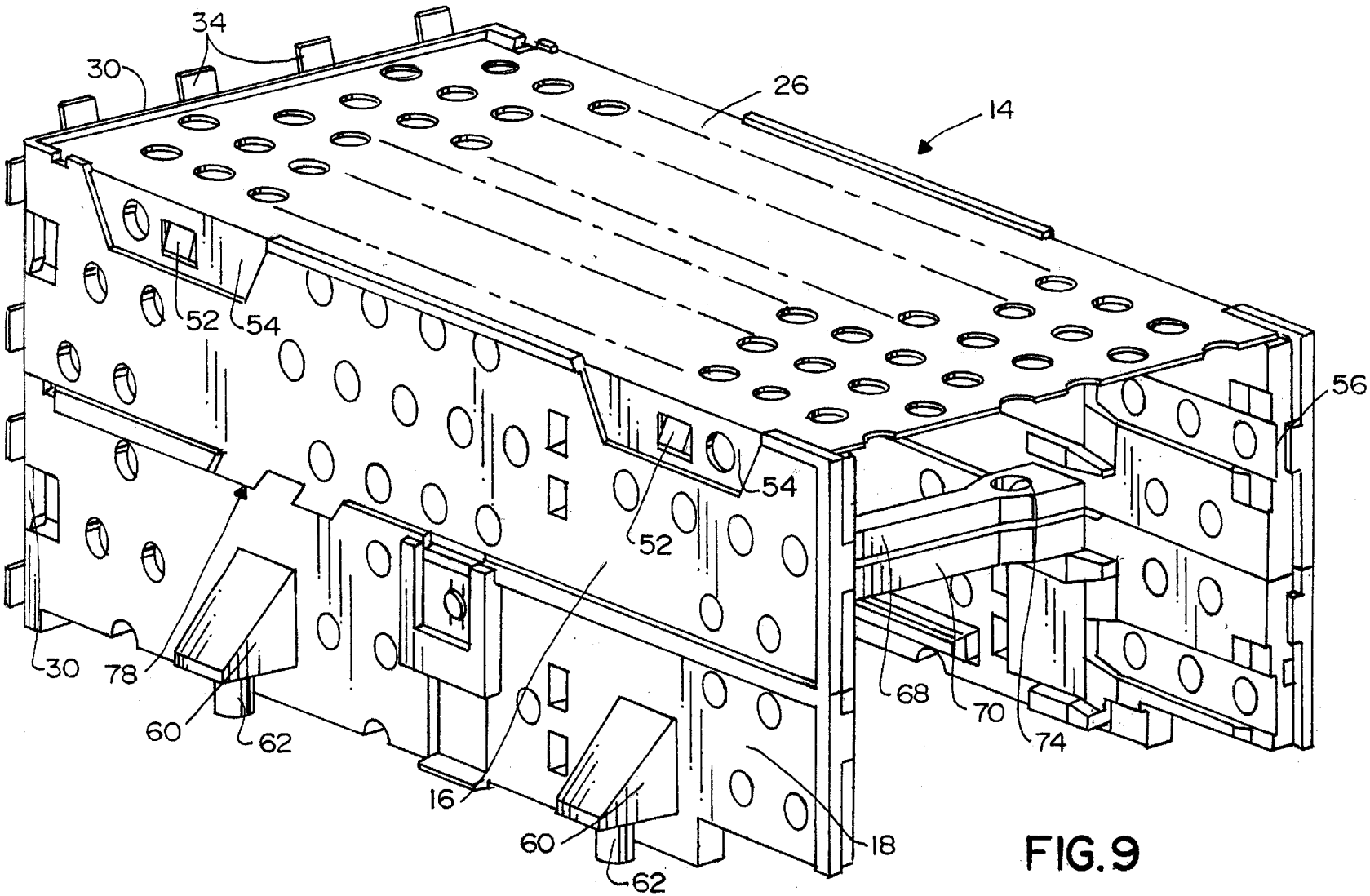
FIG. 9 is a view similar to that of FIG. 5, but with the spacer removed and the shielding top wall mounted on the top frame structure.

Referring now to FIGS. 8 and 9, it can be seen that spacer 48 (FIGS. 1–7) has been removed so that top frame structure 16 is mounted directly on top of bottom frame structure 18 to form adapter frame assembly 14 with more closely spaced receptacles 20. This arrangement would accommodate differently configured mating connectors in situations where a more compact connector assembly is desired or necessary. With the spacer removed, it can be seen in FIG. 9 that cross brace 68 of top frame structure 16 rests directly on top of cross brace 70 of bottom frame structure 18. Holes 74 still are in vertical alignment for receiving a fastener, such as a rivet, to rigidly hold the two frame structures together. Again, tongue-and-groove structure 78 is interengaged without the spacer.

FIG. 8 shows a feature of the invention whereby fingers 34 of EMI gaskets 30 do not interfere with the positioning of frame structures 16 and 18 in their more closely spaced arrangement. Specifically, it can be seen that fingers 34 of the two gaskets between receptacles 20 are offset relative to each other to allow the frame structures to be relatively closely spaced without the fingers of one gasket abutting into the fingers of the other gasket.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An adapter frame assembly for receiving at least a pair of connectors in a stacked array with one connector above another connector at different spacings therebetween, comprising:

at least a pair of frame structures including at least a top frame structure and a bottom frame structure each including a receptacle for receiving a respective one of the stacked connectors;

mounting means on the frame structures to mount the top frame structure directly on top of the bottom frame structure and thereby space the receptacles and the respective connectors at a first spacing therebetween; and spacer means separate and independent from the frame structures and being selectively mountable between said frame structures to thereby space the receptacles and the respective connectors at a second, increased spacing therebetween.

2. The adapter frame assembly of claim 1 wherein said spacer means include mounting means positionable between said mounting means of the frame structures.

3. The adapter frame assembly of claim 2 wherein said mounting means of the spacer means and the mounting means of the frame structures all are in alignment for receiving a common fastener means.

4. The adapter frame assembly of claim 3 wherein said mounting means of the spacer means and the frame structures have at least one set of aligned apertures for receiving an elongated fastener.

5. The adapter frame assembly of claim 1 wherein said spacer means and frame structures have aligned abutting brace members.

6. The adapter frame assembly of claim 5 wherein said brace members have at least one set of aligned apertures for receiving a common elongated fastener.

7. The adapter frame assembly of claim 1 wherein said frame structures are substantially fabricated of diecast metal.

8. The adapter frame assembly of claim 7 wherein said top frame structure includes a sheet metal cover.

9. The adapter frame assembly of claim 1 wherein said bottom frame structure includes means for mounting on a printed circuit board.

10. The adapter frame assembly of claim 1 wherein said top and bottom frame structures include stamped and formed sheet metal gaskets about said receptacles, each gasket including a plurality of outwardly projecting fingers for engaging a panel about a pair of openings in the panel aligned with the receptacles, the fingers of the two gaskets between the receptacles being sufficiently spaced and offset relative to each other to allow the frame structures to be relatively closely spaced at least in said first spacing therebetween.

11. An adapter frame assembly for receiving at least a pair of connectors in a stacked array with one connector above another connector at different spacings therebetween, comprising:

at least a pair of diecast metal frame structures including at least a top frame structure and a bottom frame structure each including a receptacle for receiving a respective one of the stacked connectors, the bottom frame structure including means for mounting on a printed circuit board;

mounting means on the frame structures to mount the top frame structure directly on top of the bottom frame structure and thereby space the receptacles and the respective connectors at a first spacing therebetween;

spacer means separate and independent from the frame structures and being selectively mountable between said frame structures to thereby space the receptacles and the respective connectors at a second, increased spacing therebetween; and mounting means on the spacer means positionable between said mounting means of the frame structures, with the mounting means of the spacer means and the mounting means of the frame structures all being in alignment for receiving a common fastener means.

12. The adapter frame assembly of claim 11 wherein said mounting means of the spacer means and the frame structures comprise aligned abutting brace members having at least one set of aligned apertures for receiving an elongated fastener.

13. The adapter frame assembly of claim 11 wherein said top frame structure includes a sheet metal cover.

14. The adapter frame assembly of claim 11 wherein said top and bottom frame structures include stamped and formed sheet metal gaskets about said receptacles, each gasket including a plurality of outwardly projecting fingers for engaging a panel about a pair of openings in the panel aligned with the receptacles, the fingers of the two gaskets between the receptacles being sufficiently spaced and offset relative to each other to allow the frame structures to be relatively closely spaced at least in said first spacing therebetween.

15. An adapter frame assembly for receiving at least a pair of connectors in a stacked array with one connector above another connector at different spacings therebetween, comprising:

at least a pair of frame structures including at least a top frame structure and a bottom frame structure each including a receptacle for receiving a respective one of the stacked connectors; and a pair of stamped and formed sheet metal gaskets on the frame structures about the respective receptacles thereof, each gasket including a plurality of outwardly projecting fingers for engaging a panel about a pair of openings in the panel aligned with the receptacles, the fingers of the two gaskets between the receptacles being sufficiently spaced and offset relative to each other to allow the frame structures to be relatively closely spaced.

* * * * *